United States Patent [19]

Chang et al.

[11] 3,961,639

[45] June 8, 1976

[54] METHODS AND COMPOSITIONS FOR REDUCING THE FRICTIONAL RESISTANCE TO FLOW OF AQUEOUS LIQUIDS

[75] Inventors: Jen-Lin Chang, Chicago, Ill.; Jacques L. Zakin, Rolla, Mo.

[73] Assignee: The Curators of the University of Missouri, Columbia, Mo.

[22] Filed: Sept. 10, 1973

[21] Appl. No.: 395,946

[52] U.S. Cl. ..... 137/13; 252/8.55 R; 302/66

[51] Int. Cl.[2] ..... F17D 1/08

[58] Field of Search ..... 252/8.55 R, 8.55 D, 252/DIG. 1, DIG. 14, 173; 137/13

[56] References Cited

UNITED STATES PATENTS

| | | | |
|---|---|---|---|
| 2,533,878 | 12/1950 | Clark et al. | 137/13 |
| 2,913,417 | 11/1959 | Weeks | 252/DIG. 1 |
| 3,346,047 | 10/1967 | Townsend et al. | 252/8.55 X |
| 3,361,213 | 1/1968 | Savins | 137/13 X |
| 3,472,769 | 10/1969 | Lummus et al. | 137/13 X |
| 3,553,130 | 1/1971 | Stratton | 252/8.55 |
| 3,679,608 | 7/1972 | Aubert et al. | 252/559 X |
| 3,736,288 | 5/1973 | Stratta et al. | 137/13 X |

OTHER PUBLICATIONS

Shick, Nonionic Surfactants, vol. 2, Pub. 1967, pp. 500–504.

*Primary Examiner*—Herbert B. Guynn
*Attorney, Agent, or Firm*—Koenig, Senniger, Powers and Leavitt

[57] ABSTRACT

The frictional energy losses in the flow of an aqueous liquid along a surface such as the inside wall of a pipe are reduced by incorporating a polyethylene oxide alcohol surfactant into the liquid, moving the liquid on a flow path along the surface and maintaining the temperature of the liquid near to or greater than its cloud point. The frictional energy loss per unit length of the flow path is thereby reduced below the corresponding loss of energy which occurs when moving pure water at the same volumetric rate on the same path. Optionally, an electrolyte or salt is included in the aqueous mixture to depress the cloud point thereof. Preferably, the surfactant employed contains between about 12 and 18 carbon atoms in its lipophilic moiety and between about 3 and about 9 ethylene oxide units in its hydrophilic moiety.

10 Claims, 8 Drawing Figures f VS $N_{Re}$ FOR 1.0% ALFONIC 1214 SOLUTIONS AT 30.0°C f VS. $N_{Re}$ FOR 1% ALFONIC 1214 SOLUTIONS WITH $Na_2SO_4$ AT 30.0°C (LOW CONCENTRATIONS)

f VS $N_{Re}$ FOR 1% ALFONIC 1214 SOLUTIONS WITH $Na_2SO_4$ AT 30.0°C f VS $N_{Re}$ FOR 1% ALFONIC 12/14 SOLUTIONS WITH $K_3PO_4$ AT 30.0°C f VS $N_{Re}$ FOR 1% ALFONIC 1214 SOLUTIONS WITH $Na_2S_2O_3$ AT 30.0°C f VS $N_{Re}$ FOR 0.5% ALFONIC 1214 SOLUTIONS WITH $Na_2SO_4$ AND $Na_2S_2O_3$ AT 30.0°C f VS $N_{Re}$ FOR 1% ALFONIC 1214 SOLUTIONS WITH $Na_2SO_4$ AND $Na_2S_2O_3$ AT 30.0°C

METHODS AND COMPOSITIONS FOR REDUCING THE FRICTIONAL RESISTANCE TO FLOW OF AQUEOUS LIQUIDS

BACKGROUND OF THE INVENTION

This invention relates to the field of fluid dynamics and, more particularly, to improved methods and compositions useful in reducing the frictional resistance encountered in the flow of aqueous liquids.

It has previously been known that various additives have the capability of reducing the extent of pressure drop resulting from energy consumed through friction between a flowing liquid and a surface, such as the inside wall of a pipe, along which the liquid is flowing. Particular applications in which such additives have been employed are water flow through long hoses used in fire fighting and in injection at the wetted surfaces of ships and torpedoes to reduce the drag resistance to passage of the vessel through the water.

An important potential application for drag reducing additives is in the proposed Alaskan pipline. If a conventional hot oil pipeline were installed underground in Alaska, it would cause melting of the permafrost and consequent subsidence and environmental damage on the north slope. Installation of such a pipeline above ground would expose the line to mechanical damage and have other adverse environmental effects, such as serving as a barrier to the migration of certain animals. To avoid these alternative problems, it has been proposed to transport crude oil from the north slope in the form of a cold oil-in-water emulsion or dispersion. The use of drag reducing additives effective in aqueous liquids carries the potential for significant reduction both in the energy requirements and maximum line pressure in an oil-in-water dispersion system.

High polymer solutes, soap solutes and suspended fibrous solids have all demonstrated the ability to reduce friction or drag in turbulent flow of aqueous liquids. High polymer additives are of limited utility, however, since they are subject to irreversible mechanical degradation in regions of high shear such as in pumps or in flow through narrow clearances. The low molecular weight degradation products are much less effective drag reducers. A further practical impediment to the use of polymer additives is presented by the very slow rates at which such additives dissolve. Weeks or even months may be required for dissolution to be completed.

Soap additives do not suffer the disadvantage of irreversible mechanical shear degradation. Mechanical degradation, is observed in such systems, but is reversible, and full drag reduction ability is regained once the solution is removed from a high stress region. Soap additives, however, do suffer from other drawbacks. Thus, metallic soaps of fatty acids are limited in their application because calcium and other cations normally present in tap water or sea water cause precipitation of insoluble soaps.

Another soap additive, which is reportedly effective as a drag reducer, is a complex soap containing equimolor amounts of cetyltrimethylammonium bromide and 1-naphthol. This soap does not precipitate in the presence of calcium ions, but its components are expensive and degrade chemically in aqueous solutions in the course of a few days.

Achievement of effective drag reduction with solid suspension requires high concentrations of solids with attendant settling and plugging problems. The drawbacks of a solid suspension system would be particularly severe in a long pipeline, especially one which traverses a remote area. Also, or course, the suspended solid must be separated from the liquid at its destination and the separation would require additional equipment with potential operational problems and yield losses.

An unfulfilled need has, therefore, existed for improved methods and compositions for reducing frictional resistance to flow in pipelines and along other surfaces.

SUMMARY OF THE INVENTION

It is an object of the present invention to provide improved methods and compositions for reducing the frictional resistance to flow of aqueous liquids. It is a further object of the present invention to provide such methods in which the drag reducing additive is not subject to irreversible mechanical degradation. It is also an object of the present invention to provide such methods and compositions in which the drag reducing additive is present in relatively small proportions. Another object of the invention is to provide such methods which will not involve any serious risk of plugging of the pipelines through which the compositions of the invention are pumped. A still further object of the invention is to provide methods and compositions which will not lead to the corrosion of ordinary steel pipe or other flow path surfaces.

In essence, the present invention is directed to a method for reducing the frictional energy losses in the flow of an aqueous liquid along a surface. In this method a polyethylene oxide alcohol surfactant is incorporated into the aqueous liquid. This liquid is moved on a flow path along said surface while maintaining the temperature of the mixture near to or greater than its cloud point, whereby the frictional energy loss per unit length of said flow path is less than the corresponding loss of energy which occurs when moving substantially pure water at the same volumetric rate on the same path.

DESCRIPTION OF THE PREFERRED EMBODIMENTS

Figure 1:
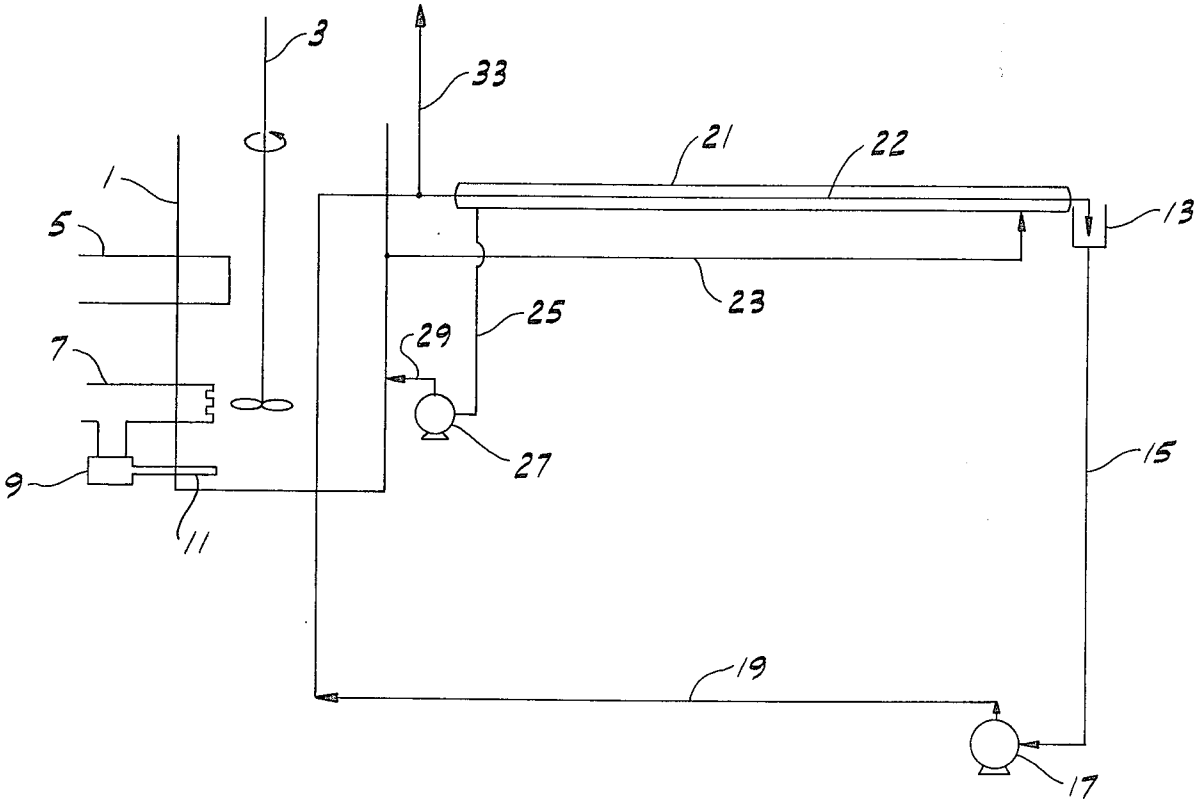
FIG. 1 is a schematic diagram showing the test used to determine frictional resistance to flow for various aqueous liquids.

In accordance with the present invention, it has now been discovered that polyethylene oxide alcohol type nonionic surfactants are particularly advantageous drag reducing agents for aqueous liquids, and that drag reduction effectiveness is greatly enhanced if the temperature of a mixture containing water and the polyethylene oxide alcohol surfactant is maintained near to or above its cloud point. This result is somewhat paradoxical, since the viscosity of mixtures of water and polyethylene oxide alcohols increase as the cloud point is approached and actually pass through a maximum near to or at the cloud point. Instead of the increase in flow resistance which would be expected to result from an increase of viscosity in terms of the conventional Fanning friction equation, however, a marked decrease of flow resistance is observed as a solution of polyethylene oxide alcohol in water approaches its cloud point.

Drag reduction may be defined as the increase in pumpability of a fluid caused by the addition of a small amount of another substance to the fluid (Savins, J. G., J. Inst. Pet. 47, 329 [1961]). Thus, drag reduction may be defined as:

$$D_R = \frac{(\Delta P)\text{ solution}}{(\Delta P)\text{ solvent}}$$

or $$D_R = \frac{f\text{ solution}}{f\text{ solvent}}$$

where $(\Delta P)$ solution is the pressure drop for the solution, $(\Delta P)$ solvent is the pressure drop for the solvent at the same flow rate and f solution and f solvent are the respective Fanning friction factors.

Mixtures of water and polyethylene oxide alcohols have a lower consolute temperature, i.e., a temperature below which the two components are fully miscible and above which a two-phase region exists. Thus, a sufficient increase in temperature for a given mixture will cause phase separation commencing at the cloud point. Although we do not wish to be held to any particular theory, it is believed that, as the cloud point approaches, micelles of the surfactant increase in size and affect the viscoelastic properties of the aqueous mixtures so as to reduce the extent of internal turbulence, and thus cause a reduction in drag despite the increase in viscosity. Above the cloud point, the viscosity decreases with increasing temperature, but effective drag reduction continues to be realized. It is believed that the continued effectiveness in drag reduction may result from the presence of large micelles in the separated phase.

Only a relatively small proportion of the polyethylene oxide alcohol nonionic surfactant is required to provide a significant degree of drag reduction. Generally, the aqueous mixture should contain between about 0.2 and about 2 percent by weight surfactant with 0.5–1 percent by weight being preferred. Proportions greater than 2 percent are effective but are generally unnecessary and, of course, more expensive.

The surfactant utilized in the process of the invention preferably contains between about 12 and about 18 carbon atoms in its lipophilic moiety and between about 3 and about 9 ethylene oxide units in its hydrophilic moiety. Among the particular surfactants which have been found effective are those sold under the trade designations Alfonic 1214-60 and Alfonic 1218-60 by the Continental Oil Company. Alfonic 1214 is a mixture of the reaction products of $C_{12}$ and $C_{14}$ straight chain alcohols and ethylene oxide. It contains 60 percent by weight ethylene oxide and has the average chemical formula $C_{12.8}H_{26.6}(OCH_2CH_2)_{6.72}OH$. Alfonic 1218-60 is a mixture of the reaction products of $C_{12}$ and $C_{18}$ straight chain alcohols and ethylene oxide. It also contains 60 percent by weight of ethylene oxide.

The choice of a particular surfactant may depend in part upon the temperature at which the aqueous liquid is to be transported. Where the liquid is to be pumped at a low temperature, it is, of course, desirable that the cloud point be correspondingly low. Generally, lower cloud points are exhibited by surfactants having relatively short ethylene oxide chains.

The cloud point for an aqueous mixture containing a given proportion of a given polyethylene oxide alcohol surfactant can be depressed by the inclusion of a salt or electrolyte in the aqueous mixture. The presence of salts in solution reduces the capability of the water solvent to hydrate the surfactant and retain it in solution. A wide variety of salts or electroyltes can be used for this purpose but some materials are substantially superior to others in their ability to depress the cloud point of the surfactant solutions. It has been found that the anion has a greater influence on the cloud point depressant effect of the salt than does the cation, although the latter is not without effect. Divalent and multivalent anions, which have relatively low lyotropic numbers, are generally more effective for reducing the cloud point than are univalent anions. Experimental results indicate that the apparent order of effectiveness of anions at a 0.5N concentration of potassium salts is as follows:

phosphate > pyrosulfate > ferrocyanide > persulfate > chloride > iodide > fluoride For 0.5N sodium salt solutions, the anions can be ranked as follows:

phosphate > borate > thiosulfate > acetate = chloride > iodate > fluoride > nitrate > iodide Low lyotropic number cations are also preferred. An apparent order of effectiveness of cations based on 0.5N chloride solutions is:

iron > sodium > potassium > calcium

Particular salts which have proven to be of high practical utility in depressing the cloud points of the surfactant solutions include sodium sulfate, sodium thiosulfate, and potassium phosphate. Among the other salts or electrolytes which may be expected to find commercial use are sodium chloride, potassium chloride, potassium nitrate, sodium nitrate, potassium sulfate, potassium thiosulfate, ferric chloride, sodium persulfate, potassium persulfate, potassium ferrocyanide, potassium iodide, potassium pyrosulfate, sodium acetate, sodium tetraborate, calcium chloride, sodium phosphate, etc.

To provide a significant reduction in the cloud point, the salt should be dissolved in the water component of the aqueous mixture at a normality of at least about 0.2. The preferred normality is in the range of 0.5–1.0 and further significant reduction may be realized by normalities up to approximately 2. Even higher normalities may be desirable for very low temperature applications both for purposes of depressing the cloud point and for depressing the freezing point of the aqueous liquid.

In accordance with the method of the invention, the aqueous mixture containing water, the polyethylene oxide alcohol surfactant, and, optionally, a salt is moved on a flow path along a surface which may typically be the inside surface of a conduit such as circular pipe. Important commercial and industrial applications are anticipated for the method of the invention both in the pumping of water and in the transportation of other materials as emulsions or dispersions in a continuous aqueous phase.

The method of the present invention is not limited, however, to the flow of aqueous liquids through closed conduits. It is also highly advantageous for flow in open channels and may find further application in reducing the frictional drag on objects such as ships or torpedoes moving through a body of water. Whatever the application, the result is a lower frictional energy loss per unit length of flow path as compared with the corresponding loss of energy when moving pure water at the same volumeric rate on the same path.

Thus, through the present invention, improved reduction in the frictional resistance to flow of aqueous liquids is realized through the use of relatively small proportions of drag reducing additives which are not subject to irreversible mechanical degradation and which do not cause corrosion of ordinary steel pipe or other flow surfaces.

The following examples illustrate the invention:

EXAMPLE 1

Distilled water solutions were prepared containing 1.0 percent by volume of the nonionic surfactant sold under the trade designation Alfonic 1214. The viscosities of these solutions were measured at 30°C. and 40°C. 28 hours after their preparation using a standard Cannon Ubbelhode size 50 viscometer in a constant temperature bath held at the test temperatrue ± 0.02°C. The relative viscosity at 30°C. was 1.20 and that at 40°C. was 1.70.

A determination of the effect of the addition of various salts on the viscosity of distilled water solutions of Alfonic 1214 was made at 30°C. The results of the viscosity determinations are set forth in Table 1.

Table 1

Relative Viscosity of Surfactant Solutions with Salts in Distilled Water at 30.0°C**

| Additive | Additive Concentration Normality | 1.0%(vol) Alfonic 1214 |
|---|---|---|
| Calcium chloride | 0.5* | 1.42 |
| | 0.5 | 1.40 |
| Ferric chloride | 0.15* | 1.38 |
| | 0.5* | 1.70 |
| Sodium acetate | 0.5* | 1.57 |
| Sodium borate | 0.8* (sat'd) | 2.07 |
| | 0.5 | 2.00 |
| Sodium chloride | 0.5 | 1.57 |
| Sodium fluoride | 0.5* | 1.49 |
| Sodium iodate | 0.46 (sat'd) | 1.53 |
| Sodium iodide | 0.5 | 1.08 |
| Sodium Molybdate | 6.1* (sat'd) | 1.93 |
| Sodium nitrate | 0.5 | 1.29 |
| Sodium oxalate | 0.6*** | 1.61 |
| Sodium phosphate | 0.3 | 1.43 |
| | 0.5 | 2.15 |
| Sodium sulfate | 0.5 | 1.60 |
| Sodium thiosulfate | 0.5 | 1.68 |
| Potassium chloride | 0.5 | 1.45 |
| Potassium ferrocyanide | 0.5 | 2.10 |
| Potassium fluoride | 0.5* | 1.13 |
| | 0.5 | 1.10 |
| Potassium iodide | 0.5* | 1.21 |
| | 0.5 | 1.16 |
| Potassium persulfate | 0.4 (sat'd)* | 1.54 |
| Potassium pyrosulfate | 0.5 | 2.19 |
| Potassium phosphate | 0.5 | 2.38 |

*tap water
**one hour after preparation
***estimated value from solubility at 30.0°C saturated Further tests determining the effect of salt concentration on the viscosities of distilled water solutions of Alfonic 1214 were made at 30°C. and the results of these further tests are set forth in Table 2.

Table 2

Relative Viscosity of Alfonic 1214 Solutions in Distilled Water with Various Additives at 30.0°C*

| Additive | Normality of Additive | Relative Viscosity 0.5% (vol) | Relative Viscosity 1.0% (vol) |
|---|---|---|---|
| $Na_2S_2O_3$ | 0.1 | 1.15 | 1.39 |
| | 0.2 | 1.29 | 1.72 |
| | 0.25 | — | 1.81 |
| | 0.3 | 1.33 | 2.20 |
| | 0.35 | — | 1.92 |
| | 0.4 | 1.26 | 1.87 |
| | 0.5 | 1.15 | 1.68 |
| $K_2S_2O_7$ | 0.1 | 1.13 | 1.34 |
| | 0.2 | 1.13 | 1.52 |
| | 0.3 | 1.22 | 1.64 |
| | 0.4 | 1.23 | 1.77 |
| | 0.5 | 1.25 | 2.15 |
| | 0.6 | 1.41 | 2.33 |
| | 0.7 | 1.36 | 1.92 |
| $K_4Fe(CN)_6$ | 0.1 | 1.13 | 1.34 |
| | 0.2 | 1.18 | 1.41 |
| | 0.3 | 1.17 | 1.55 |
| | 0.4 | 1.23 | 1.77 |
| | 0.5 | 1.30 | 2.10 |
| | 0.6 | 1.26 | 1.74 |
| $Na_2SO_4$ | 0.1 | 1.11 | 1.37 |
| | 0.2 | 1.20 | 1.55 |
| | 0.3 | 1.28 | 1.75 |
| | 0.35 | 1.26 | 2.34 |
| | 0.4 | 1.39 | 2.80 |
| | 0.45 | 1.24 | 2.03 |
| | 0.5 | 1.22 | 1.58 |
| NaCl | 0.3 | | 1.40 |
| | 0.4 | | 1.53 |
| | 0.5 | | 1.57 |
| | 0.6 | | 1.77 |
| | 0.7 | | 1.98 |
| | 0.8 | | 2.31 |
| | 0.9 | | 2.92 |
| | 1.0 | | 2.46 |
| $K_3PO_4$ | 0.3 | | 1.68 |
| | 0.4 | | 2.21 |
| | 0.45 | | 2.21 |
| | 0.5 | | 2.38 |
| | 0.55 | | 2.68 |
| | 0.6 | | 2.10 |
| $NaNO_3$ | 0.3 | | 1.28 |
| | 0.5 | | 1.29 |
| | 0.7 | | 1.31 |

*at least 1 hour after adding the salts

These tests show that increases in temperature and/or additions of salts in some cases cause significant increases in the relative viscosity of the nonionic surfactant solution.

The results in the following example indicate that such large increases in viscosity are correlatable with the approach to or transversal of the cloud point of the surfactant solution.

EXAMPLE 2

A series of surfactant solutions were prepared from Alfonic 1214. Predetermined proportions of various salts were added to certain of these solutions and the cloud points of all solutions with or without salt additives were determined. Cloud point measurements were made in a test tube mounted in a water bath carried by a beaker. The water bath was slowly heated using a Bunsen flame and the temperature of the solution tested was read with a thermometer which was also used as a stirrer in the test tube. The results of the cloud point determinations are set forth in Table 3. Where the cloud point is recorded to the nearest 0.1°C., it is accurate to ± 0.1°C. and where it is recorded to the nearest degree, it is accurate to ± 0.5°C.

Table 3

| Surfactant | Cloud Point Results Surfactant Concentration % (weight) | Concentration | Cloud Point °C |
|---|---|---|---|
| Alfonic 1214 | 1.0 | 0 | 42.1 |
| Alfonic 1214 | 1.0 | 0.5N $Na_2SO_4$ | 27.6 |
| Alfonic 1214 | 1.0 | 0.1N $Na_2S_2O_3$ | 37.1 |
| Alfonic 1214 | 1.0 | 0.2N $Na_2S_2O_3$ | 33.0 |
| Alfonic 1214 | 1.0 | 0.3N $Na_2S_2O_3$ | 29.8 |
| Alfonic 1214 | 1.0 | 0.5N NaCl | 34.5 |
| Alfonic 1214 | 1.0 | 0.5N NaCl + 0.001N HCl | 34.2 |
| Alfonic 1214 | 1.0 | 0.5N NaCl + 0.001N NaOH | 34.0 |

EXAMPLE 3

An aqueous solution was prepared containing 1.0 percent by weight Alfonic 1214. Frictional flow resistance tests were conducted on this solution one day and three days after its preparation, using the capillary tube flow system schematically shown in FIG. 1. This system included a constant temperature water reservoir 1 agitated by a stirrer 3 and maintained at a constant temperature 30.0°C. (±0.1°C.) by a temperature control system consisting of a dummy cooling load provided by manual cold water supply 5 and a resistance heater 7 controlled by temperature regulator 9 in response to sensor 11. Test solution reservoir 13 was connected through suction line 15 to the inlet of variable speed metering pump 17 with a maximum capacity of 500 ml./min. Discharge line 19 from the outlet of the metering pump was directed through reservoir 1 back to solution reservoir 13. A jacket 21 was provided along test section 22 of discharge line 19 and this jacket was connected to water reservoir 1 by means of water bath supply line 23. The test section was a 0.0326 inch 1D stainless steel capillary tube mounted permanently in the ¼ inch diameter copper water jacket 21. Water bath discharge line 25 extended from jacket 21 to the inlet of a ¼ horsepower centrifugal water pump 27 and the outlet of pump 27 was connected to the water reservoir 1 through water pump discharge line 29. Pressure indicator 33 was attached to discharge line 19 just upstream of the jacketed section 21.

Pressure drop tests were conducted by pumping the test solution through the jacketed capillary section at a constant rate while controlling the temperature at 30.0°C. by circulation of the controlled temperature water through the jacket. Pressure drop measurements were made at a series of different flow rates and comparative measurements at the same flow rate were made using distilled water instead of the Alfonic solution. A mercury manometer, a process fluid manometer and pressure gauge (0–250 psi) were used to measure pressure drops, and flow rates were measured by collecting the test fluid in a graduated cylinder for from 60 to 120 seconds.

From the Fanning equation:

$$f = \frac{D \Delta P / 4L}{\rho V^2 / 2g_c}$$

Figure 2:
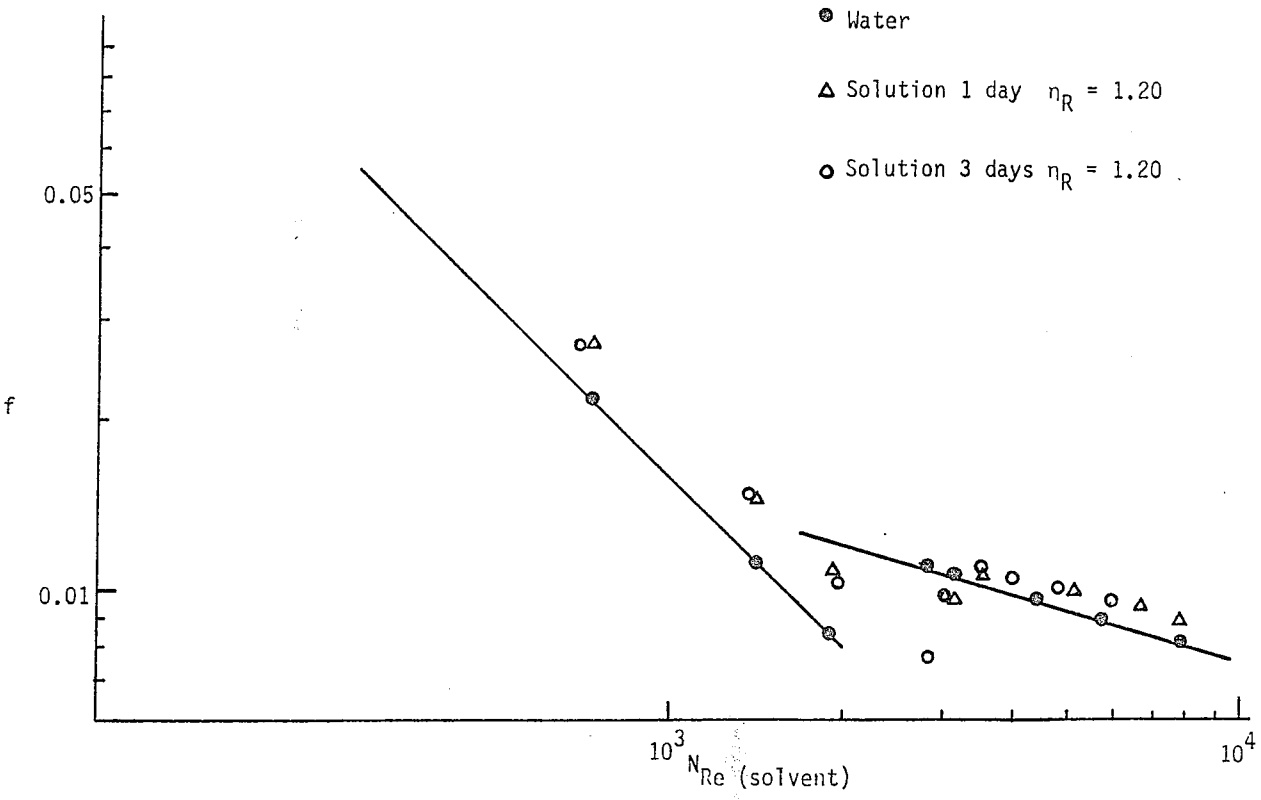
FIGS. 2–8 are plots of observed friction factors of test solutions versus the Reynolds number calculated on the basis of the properties of the water solvent.

Fanning friction factors were calculated for each flow test. FIG. 2 is a plot of the observed friction factors versus the Reynolds number calculated on the basis of the properties of the water solvent. The solid lines in FIG. 2 show the conventional friction factor Reynolds number plots determined from the accepted relationship:

$$f = \frac{16}{N_{Re}}$$

for laminar flow, and the Von Karman equation:

$$1/\sqrt{f} = A \log(N_{Re}\sqrt{f}) - C$$

where $A = 4.0$ and $C = 0.40$ for turbulent flow.

It will be noted that in the laminar region the pressure drop is somewhat higher than that for distilled water as a result of the increased viscosity of the Alfonic solution. Normal transition behavior is observed with no significant drag reduction. Transition occurs at higher solvent Reynolds number than for water because of the 20% increase in the viscosity of the solution.

EXAMPLE 4

Figure 3:
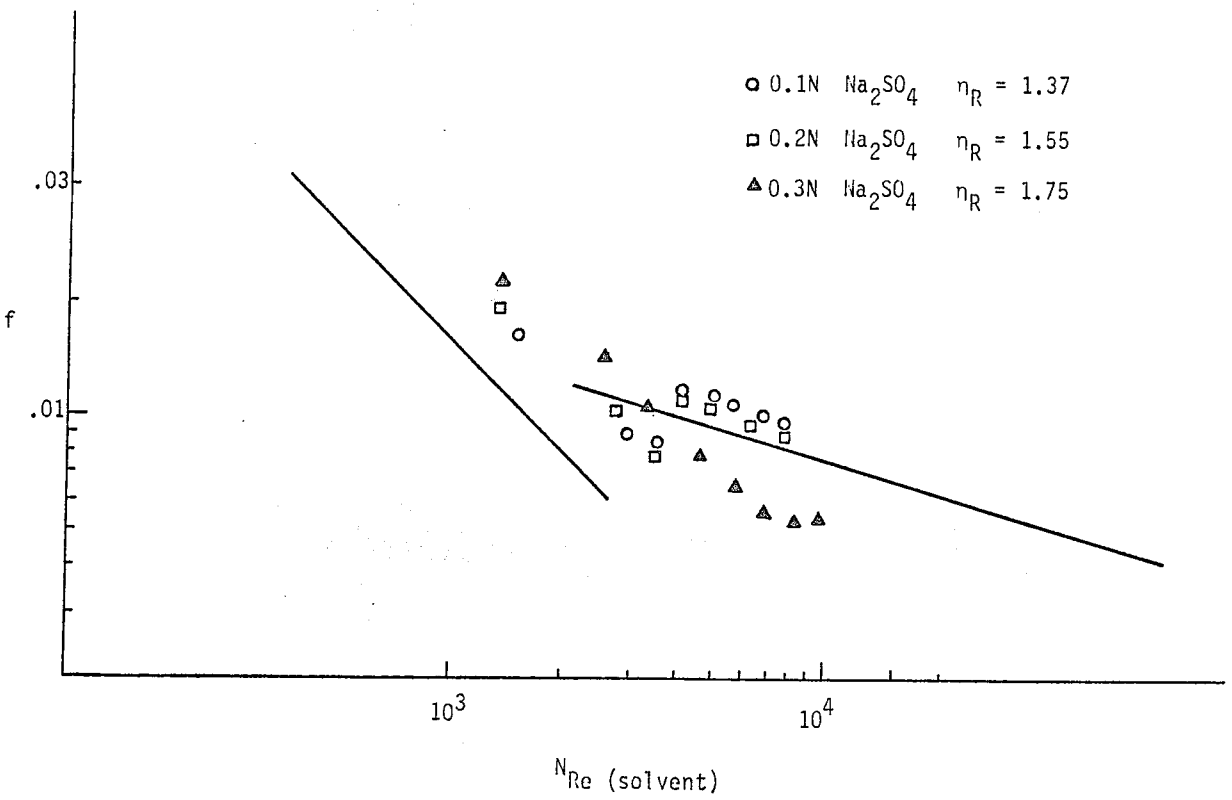

Pressure drop tests were conducted in the manner described in Example 3, except that Alfonic 1214 solutions containing 0.1N sodium sulfate, 0.2N sodium sulfate, and 0.3N sodium sulfate, respectively, were employed. FIG. 3 is a plot of observed friction factors versus solvent Reynolds numbers and indicates that a sodium sulfate concentration of 0.3N tends to stabilize the micelles and provides significant drag reduction at Reynolds numbers upward of 4,000.

EXAMPLE 5

Figure 4:
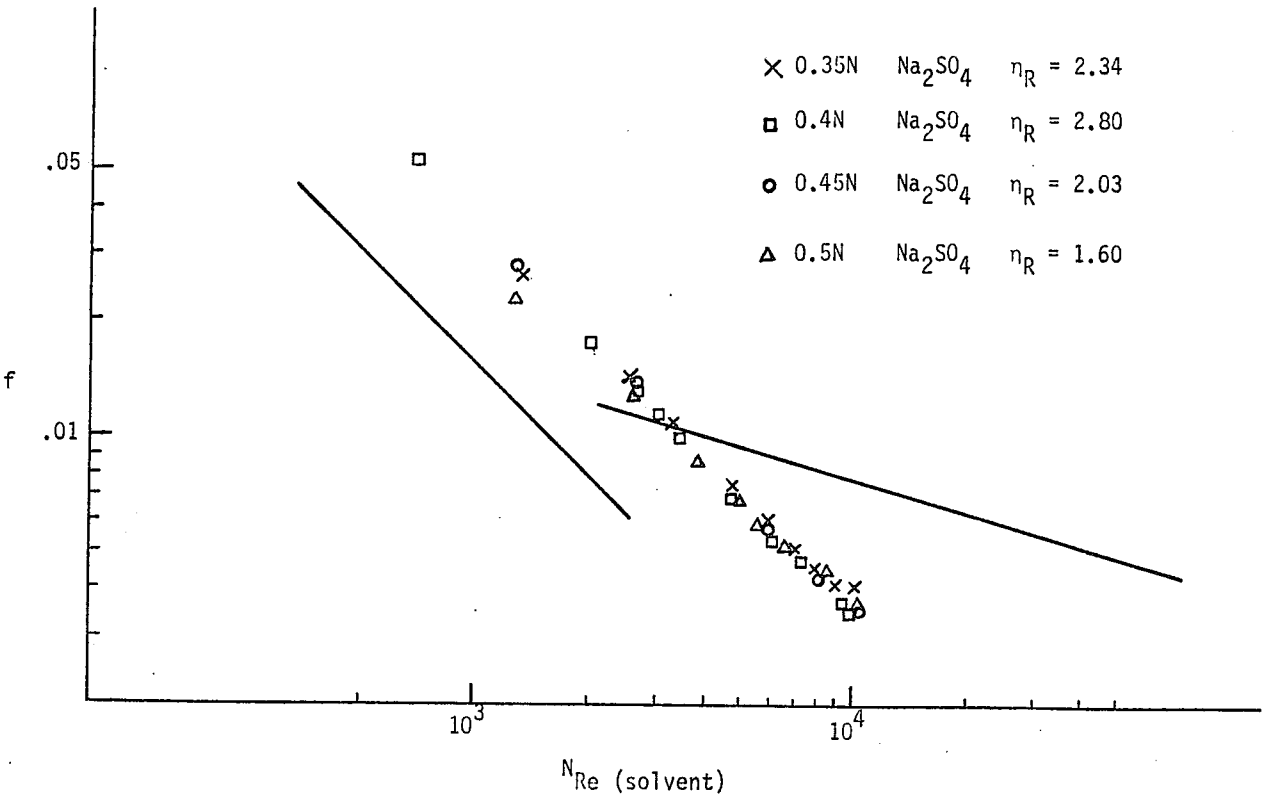

Pressure drop tests were conducted in the manner described in Example 3, except that Alfonic 1214 solutions containing 0.35N sodium sulfate, 0.4N sodium sulfate, 0.45N sodium sulfate, and 0.5N sodium sulfate, respectively, were employed. FIG. 4 shows the results of these tests and indicates substantial reduction in frictional energy losses at Reynolds numbers above about 4,000.

EXAMPLE 6

Figure 5:
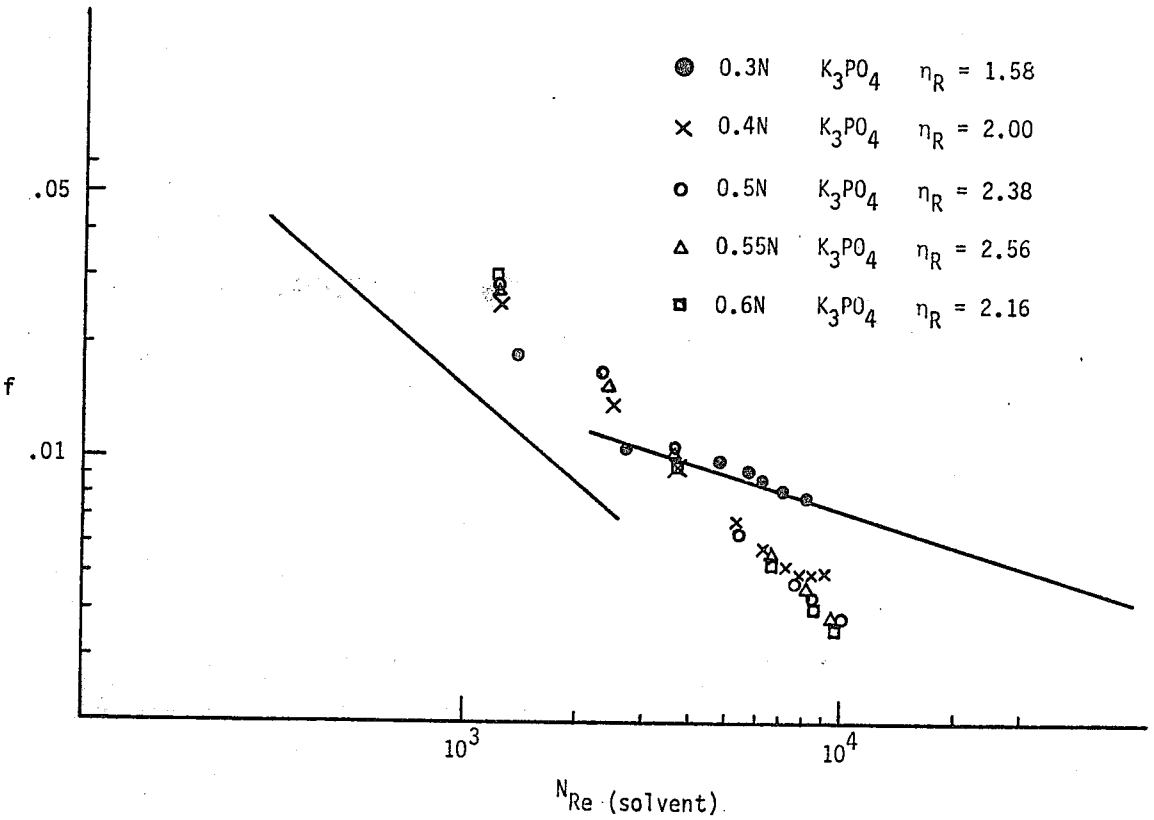

Pressure drop tests were conducted in the manner described in Example 3, except that Alfonic 1214 solutions containing 0.3N potassium phosphate, 0.4N potassium phosphate, 0.5N potassium phosphate, 0.55N potassium phosphate, and 0.6N potassium phosphate, respectively, were employed. FIG. 5 shows the results of these tests. No drag reduction was effected at 30°C. with 0.3N potassium phosphate, but the solutions containing 0.4N or more potassium phosphate showed a marked reduction in drag at Reynolds numbers above about 4,000.

EXAMPLE 7

Figure 6:
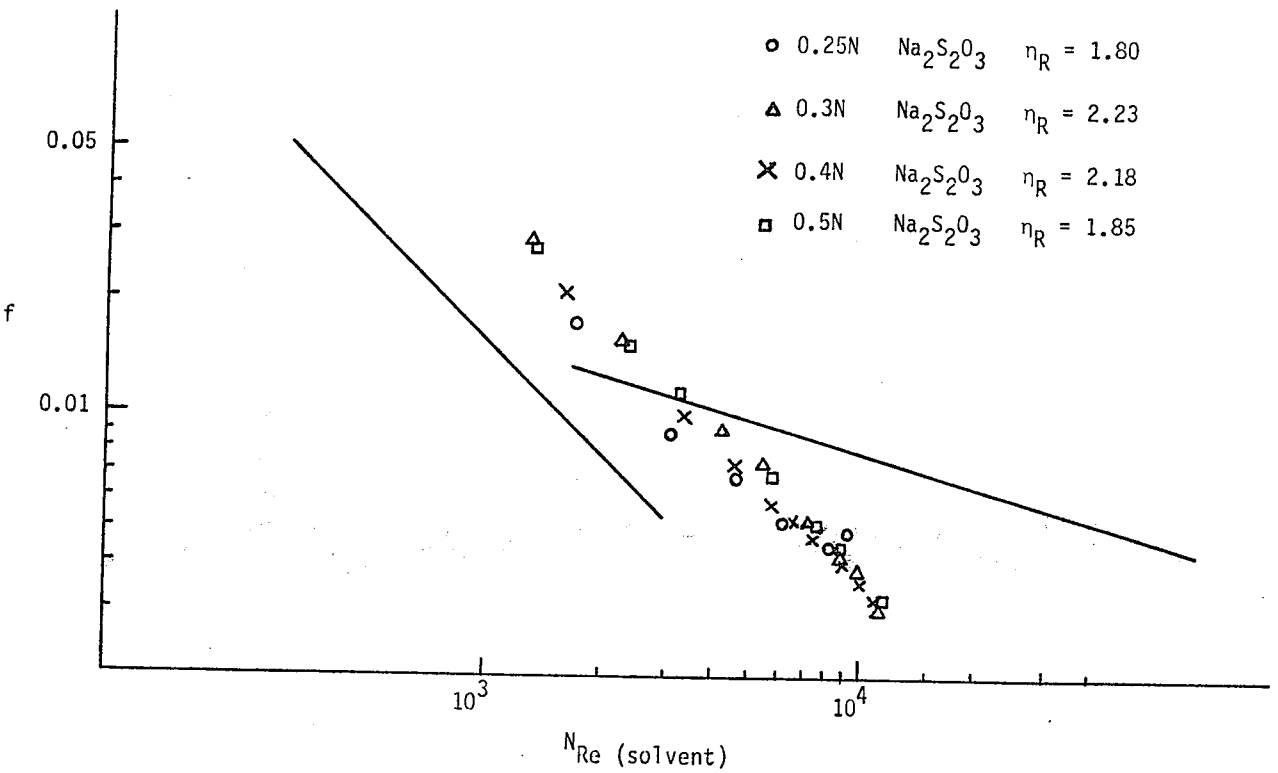

Pressure drop tests were conducted in the manner described in Example 3, except that Alfonic 1214 solutions containing 0.25N sodium thiosulfate, 0.3N sodium thiosulfate, 0.4N sodium thiosulfate, and 0.5N sodium thiosulfate, respectively, were employed. FIG. 6 shows the results of these tests and indicates significant drag reduction in all cases at Reynolds numbers above approximately 4,000.

EXAMPLE 8

Figure 7:
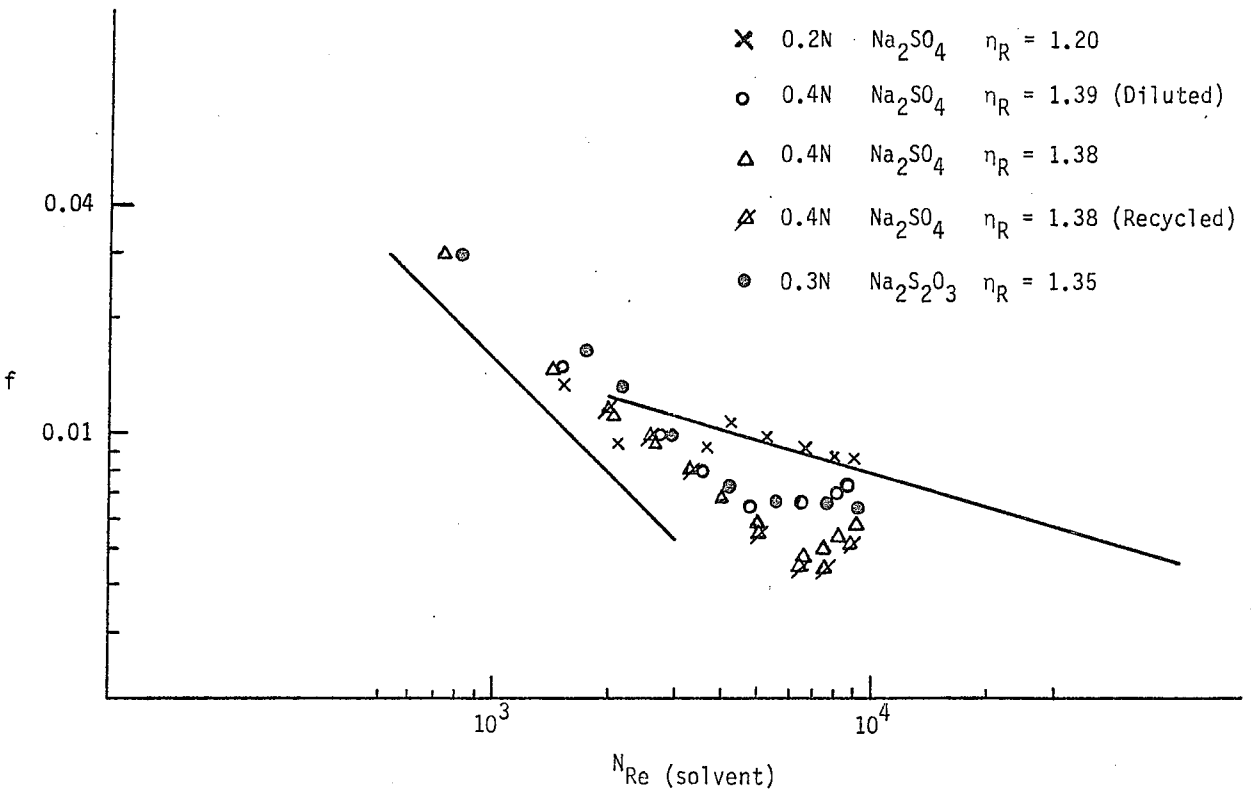

Pressure drop tests were conducted in the manner described in Example 3, except that solutions containing 0.5% by weight Alfonic 1214 and 0.2N sodium sulfate, 0.3N sodium thiosulfate, and 0.4N sodium sulfate were employed. Two different 0.4N sodium sulfate solutions were obtained, one by the direct dissolution of 0.5 percent by weight Alfonic solution in distilled water and the other by dilution of an Alfonic solution initially prepared at a 1 percent by weight strength. The 0.4N sodium sulfate solution, prepared directly from 0.5 percent by weight Alfonic 1214 and water, was also tested for any long term or cumulative effect of mechanical degradation by pumping at the maximum test flow for about an hour and then rerunning pressure drops at successively decreasing Reynolds numbers. FIG. 7 shows the results of the tests of this example and indicates no permanent effect on drag reducing properties by pumping the Alfonic solution at maximum shear for one hour.

EXAMPLE 9

Figure 8:
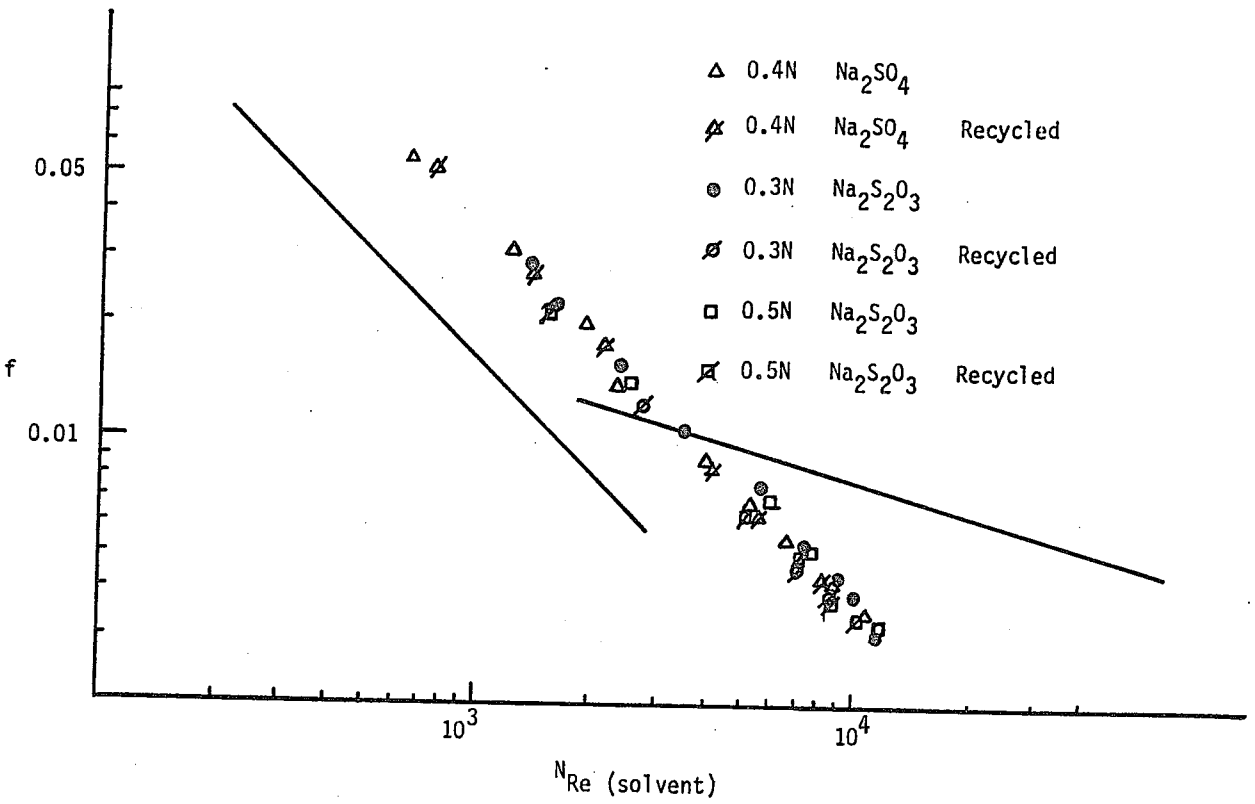

Pressure drop tests were conducted in the manner described in Example 3, except that 0.3N sodium thiosulfate, 0.4N sodium sulfate, and 0.5N sodium thiosulfate solutions were used. Each of these solutions was tested on an increasing Reynolds number schedule, then pumped at the maximum flow rate for an hour, and again tested on a decreasing Reynolds number schedule. FIG. 8 shows the results of these tests and, again, indicates no permanent adverse effect of exposure to the maximum shear stresses encountered in these tests.

In view of the above, it will be seen that the several objects of the invention are achieved and other advantageous results attained.

As various changes could be made in the above methods and products without departing from the scope of the invention, it is intended that all matter contained in the above description or shown in the accompanying drawings shall be interpreted as illustrative and not in a limiting sense.

What is claimed is:

1. A method for reducing the frictional energy losses in the flow of an aqueous liquid along a surface comprising:

incorporating into said liquid a polyethylene oxide alkyl alcohol surfactant;

moving said liquid on a flow path along said surface at a velocity sufficient to provide a Reynolds number greater than about 4000 based on the properties of water; and maintaining the temperature of said liquid near to or greater than its cloud point, whereby the frictional energy loss per unit length of said flow path is less than the corresponding loss of energy which occurs when moving substantially pure water at the same volumetric rate on the same path.

2. A method as set forth in claim 1 wherein said polyethylene oxide alkyl alcohol comprises a polyethylene oxide straight chain alkyl alcohol.

3. A method as set forth in claim 1 wherein the lipophilic moiety of said surfactant contains between about 12 and about 18 carbon atoms and the hydrophilic moiety of said surfactant contains between about 3 and about 9 ethylene oxide units.

4. A method as set forth in claim 3 wherein said mixture contains between 0.2 and about 2 percent by weight of said surfactant.

5. A method as set forth in claim 4 wherein said mixture contains between about 0.5 and about 1 percent by weight of said surfactant.

6. A method as set forth in claim 1 wherein said mixture further comprises a salt which depresses the cloud point of the mixture, said salt being selected from the group consisting of inorganic metallic salts and metal acetates.

7. A method as set forth in claim 6 wherein the normality of said salt in said mixture is at least about 0.2.

8. A method as set forth in claim 7 wherein said salt is selected from the group consisting of sodium chloride, potassium chloride, sodium sulfate, sodium thiosulfate, potassium nitrate, sodium nitrate, potassium sulfate, potassium thiosulfate, potassium phosphate, ferric chloride, sodium persulfate, potassium persulfate, potassium ferrocyanide, potassium iodide, potassium pyrosulfate, sodium acetate, sodium tetraborate, calcium chloride and sodium phosphate.

9. A method as set forth in claim 1 wherein said surface is the inside surface of a closed conduit and said flow path extends between different points inside said conduit along the length thereof.

10. A method as set forth in claim 9 wherein said mixture contains between about 0.2 and about 2 percent by weight of a polyethylene oxide alkyl alcohol whose lipophilic moiety contains between about 12 and about 18 carbon atoms and whose hydrophilic moiety contains between about 3 and about 9 ethylene oxide units, and a salt at a normality of at least about 0.2.

* * * * *